US007437826B1

(12) United States Patent
Harmon

(10) Patent No.: US 7,437,826 B1
(45) Date of Patent: Oct. 21, 2008

(54) ADJUSTABLE FRAMING TOOL FOR LAYING OUT HIP AND VALLEY RAFTERS

(76) Inventor: Mark G. Harmon, 16110 US 19 North, Thomasville, GA (US) 31757

( * ) Notice: Subject to any disclaimer, the term of this patent is extended or adjusted under 35 U.S.C. 154(b) by 0 days.

(21) Appl. No.: 11/999,780

(22) Filed: Dec. 7, 2007

(51) Int. Cl.
*B43L 7/10* (2006.01)

(52) U.S. Cl. ..... 33/417; 33/423

(58) Field of Classification Search ..... 33/415–421, 33/423, 429, 1 N, 452, 460, 471–474, 476, 33/679.1
See application file for complete search history.

(56) References Cited

U.S. PATENT DOCUMENTS 1,821,103 A * 9/1931 Luginbuhl ..... 33/417
5,419,053 A * 5/1995 Kathan ..... 33/417
6,314,652 B1 * 11/2001 English ..... 33/421

* cited by examiner

*Primary Examiner*—Yaritza Guadalupe-McCall
(74) *Attorney, Agent, or Firm*—Robert C. Brown

(57) ABSTRACT

An adjustable framing tool 10 for laying out hip and valley rafters 216. A planar body 12 has a measuring edge 14 and first and second scribing edges 16,18 disposed at right angles to the measuring edge. An arm assembly 20 comprising first and second parallel arms 22,24 disposed on opposite sides of the planar body is rotatably mounted on the planar body. The arm assembly extends across an arcuate slot 40 in the planar body centered on the pivot of the arm assembly. A thumb screw 42 selectively positions the arm assembly at any rotational position. The measuring edge is numbered in increments from 0 to 12, the length of the measuring edge being equal to 12 times the secant of the angle c formed by the hip or valley rafter 218 with the nearest common rafter 208. The slot is numbered in increments expressed as the pitch of the main roof 202.

7 Claims, 4 Drawing Sheets

ADJUSTABLE FRAMING TOOL FOR LAYING OUT HIP AND VALLEY RAFTERS

TECHNICAL FIELD

The present invention relates to tools for carpentry; more particularly, to tools for laying out cutting patterns and nailing patterns in building framing lumber; and most particularly, to an adjustable framing tool for laying out cutting patterns and nailing patterns on hip and valley rafters of hip roofs.

BACKGROUND OF THE INVENTION

Hip roofs and hip rafters are well known in the architecture and building construction arts.

A hip roof is commonly defined in the art as a roof having sloping sides and sloping ends, and a hip rafter is a rafter extending from the wall plate to the ridge and forming the angle of the hip roof. Although the definition of hip roof includes both the sides and the end, for purposes of discussion herein, the following definitions are used for the parts of a hip roof: a) the portion of the roof having a ridge beam and common rafters attaching to the sides of the ridge beam is referred to as the main roof; and b) the portion of the roof having hip rafters attaching to the end of the ridge beam and jack rafters attaching to the hip rafters is referred to as the hip roof.

A roof valley is commonly defined in the art and used herein as a place of meeting of two slopes of a roof that form a re-entrant angle, and a valley rafter is a rafter running from the wall plate along the valley to the ridge.

A roof slope or pitch is commonly defined in the art and used herein as the rise of the roof from wall plate to ridge divided by the horizontal run of the roof on the plan. Roof pitch in the United States is typically expressed as a ratio having the denominator 12, although other pitches and other measurement systems such as metric are fully comprehended by the present invention.

Plan angle refers to an angle between two non-horizontal elements when projected onto a horizontal surface such as the surface defined by the wall plates of the building.

Common rafters are rafters in a main roof extending orthogonally from the side wall plate to the ridge. A hip rafter meets the ridge at the joining point of the last common rafter to the ridge. Jack rafters are shorter rafters extending from the side wall plate or end wall plate to a hip rafter, or from the ridge to a valley rafter.

For clarity, the following presentation deals only with hip rafters, but those of ordinary skill in the carpenterial arts will recognize that the presentation and present invention are equally applicable to valley rafters.

In building a conventionally-framed wood building having a hip roof, the lengths and cutting angles for the hip rafters from raw planks, and the correct nailing locations for jack rafters to the hip rafters, must be determined.

A typical hip roof has two identical hip rafters symmetrically arranged on either side of, and meeting at, the end of the roof ridge (which typically although not necessarily contains a horizontal ridge pole or ridge beam). Generally, a hip rafter bisects the meeting angle of the side wall and end wall plates. Thus, in a typical hip roof for rectangular construction the side wall and end wall plates meet at a 90° angle and the hip rafter bisects the angle, meeting both plates at a 45° angle to each one. In other constructions, for example octagonal, the side wall and end wall plates meet at an included 135° angle, and the hip rafter bisects that angle and meets both plates at a 67.5° angle.

When the hip rafter bisects the plate angle, the pitch of the main roof and the hip roof must be the same. However, in other roofs wherein the hip rafter does not bisect the plate angle, the hip roof pitch must differ from the main roof pitch. Such cases show that of the two angles formed by the hip rafter, only the angle formed with the last common rafter is important in laying out the hip rafter.

Thus, the laying out of a hip rafter requires simultaneous combining of the main roof pitch, the actual roof rise, and the plan or projected meeting angle between the hip rafter and the end wall plate. In the prior art, the layout of the hip rafter is accomplished in a wide variety of ways, from calculation by the Pythagorean Theorem to use of direct measurement and tables of trigonometric functions. All of these are difficult, time-consuming, and require in the carpenter a good understanding of three-dimensional trigonometry.

What is needed in the art is a simple framing tool that can incorporate the required trigonometric functions directly to allow easy measurement and marking of cuts and rafter nailing patterns in laying out a hip rafter.

It is a principal object of the present invention to simplify and make more reliable the creation of a hip rafter for a hip roof.

SUMMARY OF THE INVENTION

Briefly described, an adjustable framing tool for laying out hip and valley rafters comprises a planar body having three linear edges: a measuring edge and first and second scribing edges disposed at right angles to the measuring edge at opposite ends thereof. A rafter pitch arm assembly comprising first and second arms disposed on opposite sides of the planar body is rotatably mounted at a first end thereof at a distance from the measuring edge. The second end of the rafter pitch arm assembly extends across an arcuate slot formed in the planar body and centered on the pivot of the pitch arm assembly. An adjustable thumb screw extends through the first and second arms and through the slot to temporarily and selectively position the arm assembly at any desired rotational position. The measuring edge is numbered in evenly-spaced increments from 0 to 12, preferably in increments of 0.25 or less. The length of the measuring edge is equal to 12 times the secant of the angle formed by the hip or valley rafter with the nearest common rafter at either the ridge (hip rafter) or side wall plate (valley rafter). Thus, the measuring edge increments are defined as a secant measuring scale. The slot is numbered in increments expressed as the pitch of the main roof, the increments being placed in accordance with the tangent of the main roof rise over the known plan-projected length of the hip rafter.

In use, the rafter arm assembly is set at the rise of the main roof. The tool is then placed on the plank which will form the hip rafter with the arm assembly against one edge thereof. The distance between the first and second scribing edges thus represents the length in inches of hip rafter corresponding to 12 inches of length of the wall plate. The length of wall plate from the last common rafter to the hip rafter is known in feet and inches. The tool is then advanced along the board by the same number of feet and inches as expressed by the width of the tool and the measuring edge to arrive at the correct length for the hip rafter. The tool may be similarly employed to lay out the nailing locations for jack rafters to be installed from the plate to the hip rafter. For example, if the rafter spacing is 16 inches on-center on the wall plate, the tool is successively advanced on the hip rafter and marked every 16 "inches" on the secant measuring scale.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
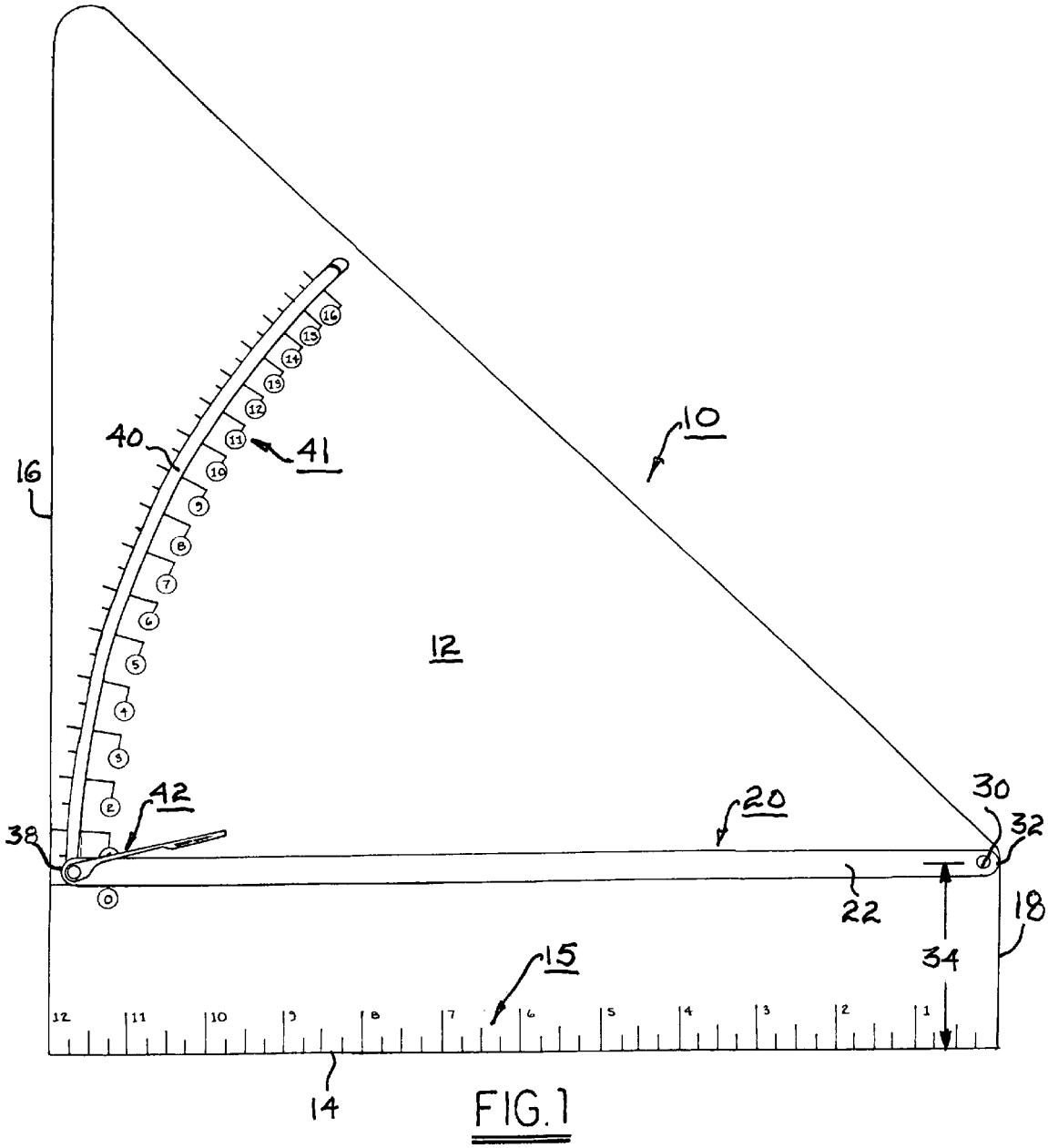
FIG. 1 is a plan view of an exemplary adjustable hip framing tool in accordance with the present invention.
Figure 2:
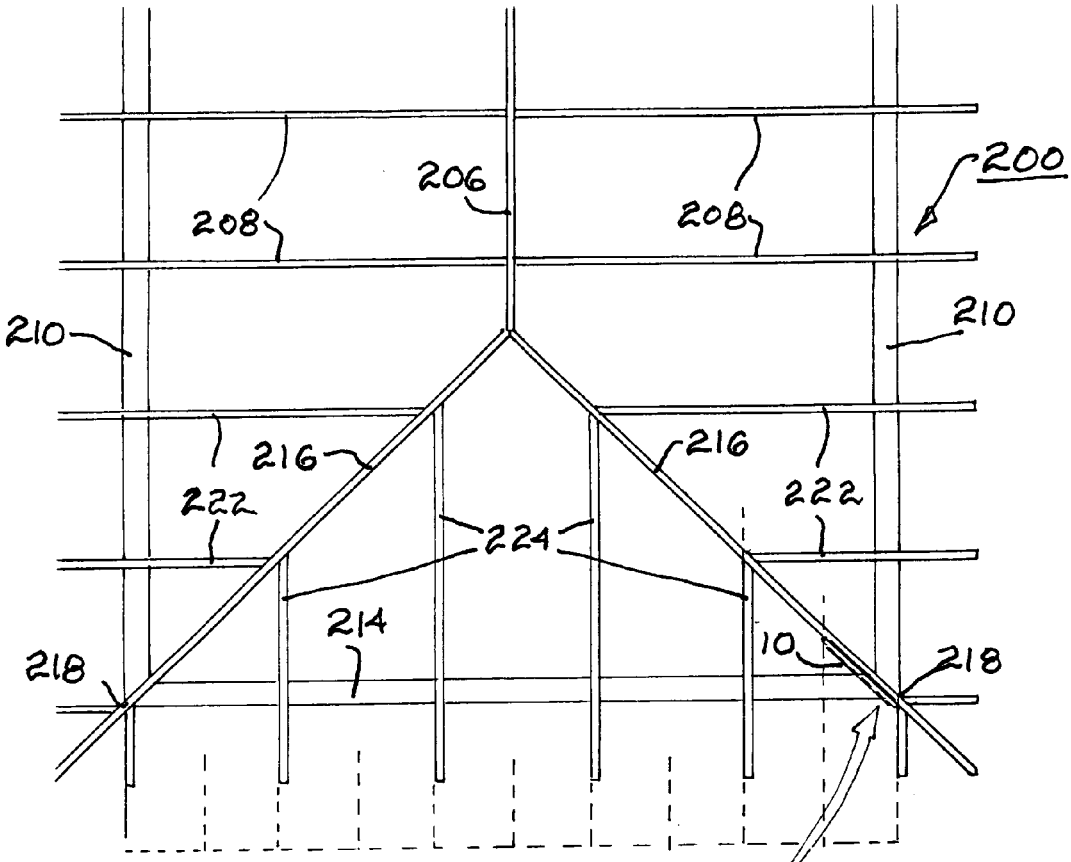
FIG. 2 is a plan view of a hip roof, showing the principal timbers.
Figure 3:
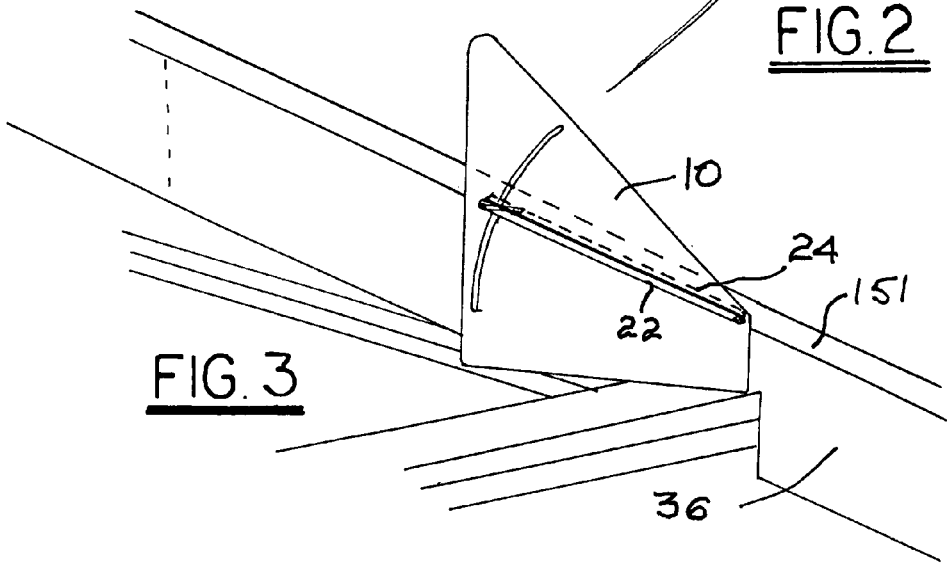
FIG. 3 is an isometric view showing placement of an adjustable hip framing tool on a hip rafter for measuring length of the hip rafter.
Figure 4:
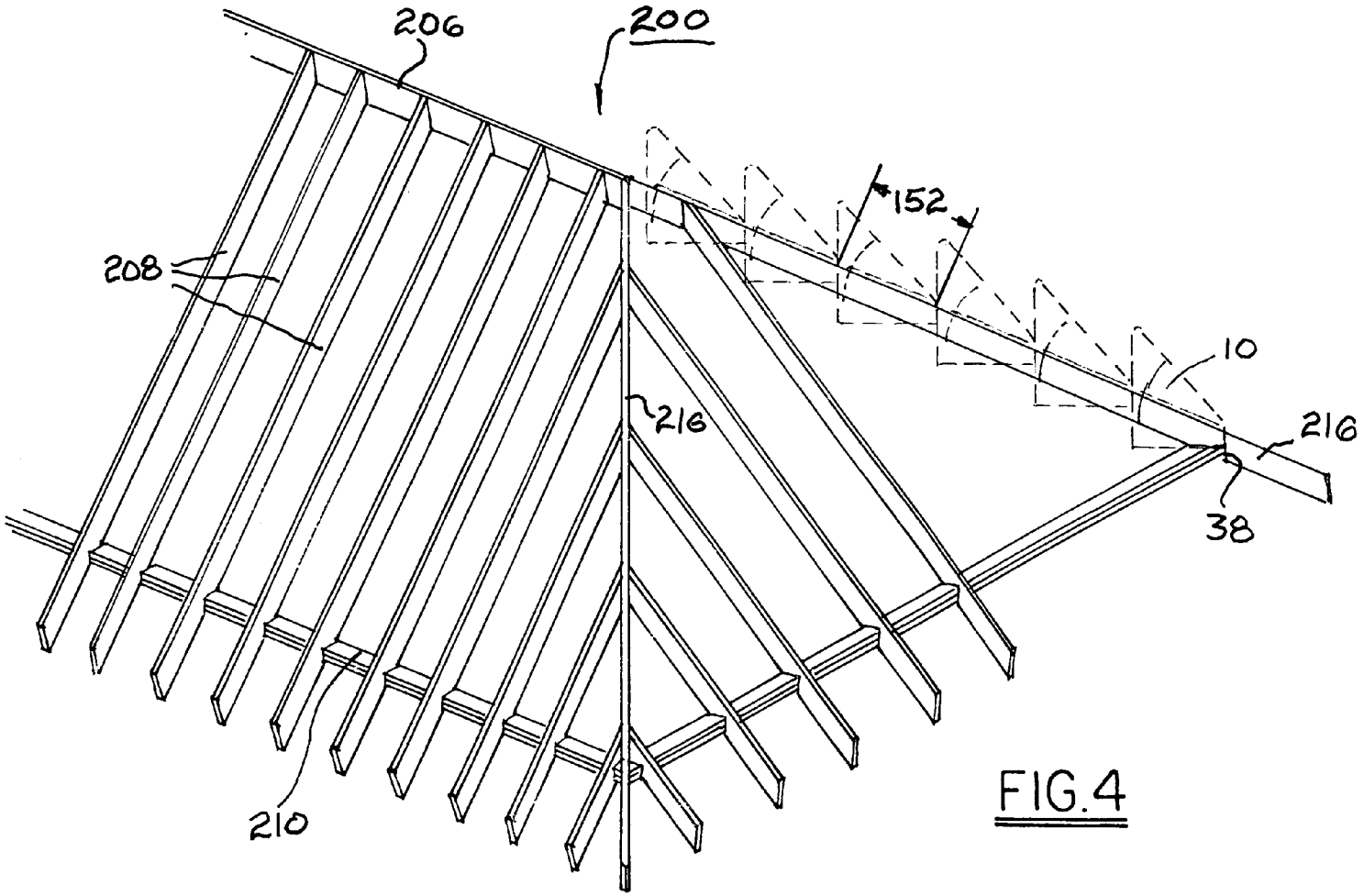
FIG. 4 is an isometric view of a hip roof showing progressive steps in using the tool shown in FIG. 1 to determine overall length of a hip rafter.
Figure 5:
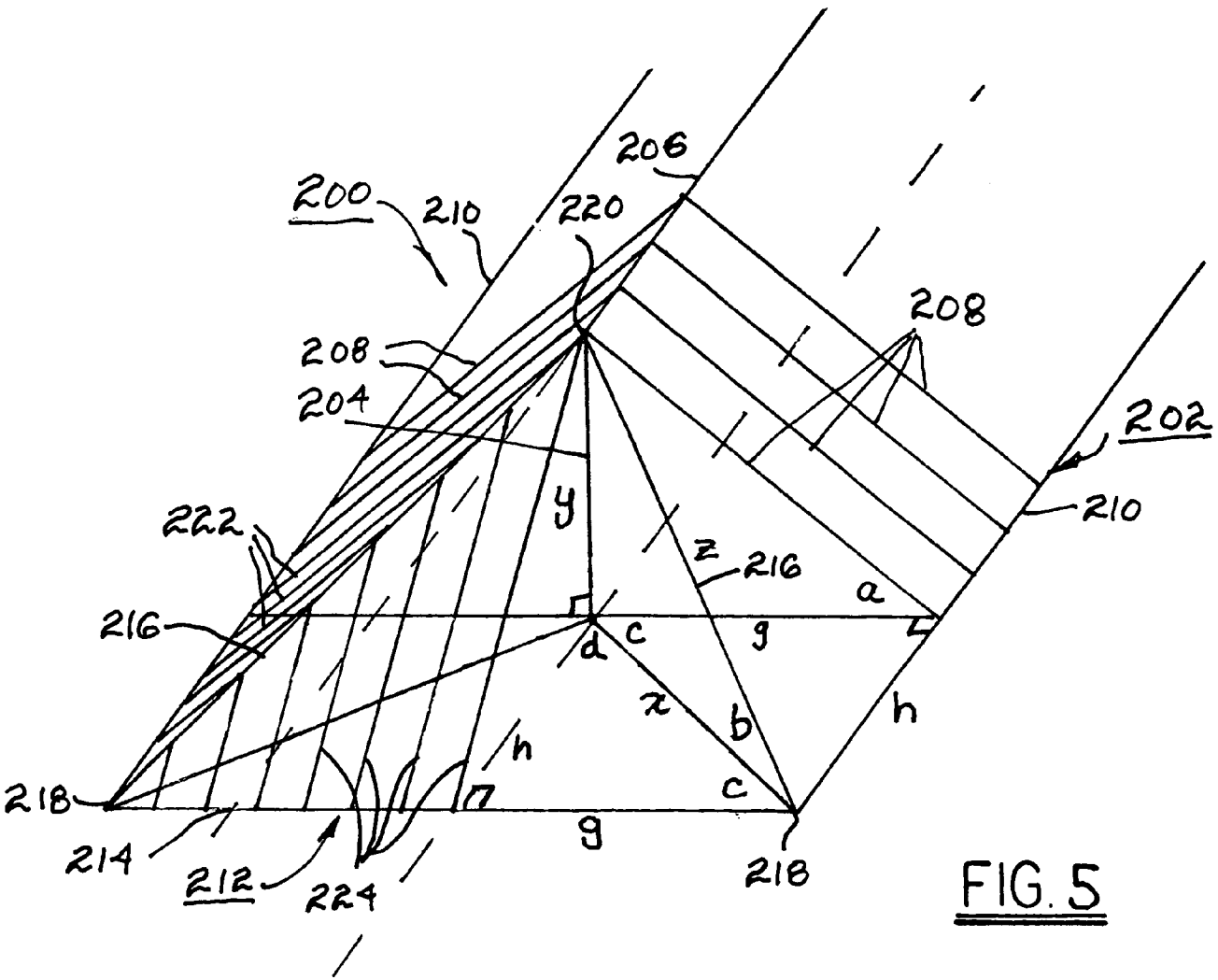
FIG. 5 is a schematic isometric drawing showing trigonometric relationships between a hip rafter, wall plates, a main roof ridge, jack rafters, and common rafters, which relationships are necessarily calculated in constructing a tool in accordance with the present invention.

Referring to FIGS. 1 through 5, an adjustable framing tool 10 for laying out hip and valley rafters in accordance with the present invention comprises a planar body 12 having three linear edges: a measuring edge 14 and first and second scribing edges 16,18 disposed at right angles to measuring edge 14 at opposite ends thereof. Planar body 12 may be formed of any convenient rigid sheet material, such as a plastic or a metal. A rafter pitch arm assembly 20 comprising parallel first and second arms 22,24 disposed on opposite sides of planar body 12 is rotatably mounted on a pivot pin 30 at a first end 32 thereof at a distance 34 from measuring edge 14. Distance 34 is not critical and serves to provide a useful scribing length for second edge 18 although distance 34 must be less than the width of the board 36 to be formed into a hip rafter 216. Second end 38 of rafter pitch arm assembly 20 extends across an arcuate slot 40 formed in planar body 12 and centered on pivot pin 30. An adjustable thumb screw mechanism 42 extends through first and second arms 22,24 and through slot 40 to temporarily and selectively position rafter arm assembly 20 at any desired rotational position. Measuring edge 14 is numbered in evenly-spaced increments from 0 to 12, preferably in increments of 0.25 or less. The length of measuring edge 14 is equal to 12 times the secant of angle a (FIG. 5) formed by the hip (or valley, not shown) rafter with the nearest common rafter at either the ridge (hip rafter) or side wall plate (valley rafter, not shown). Thus, the measuring edge increments are defined as a secant measuring scale 15. Slot 40 is numbered in increments expressed as the pitch of the main roof, the arcuate increment scale 41 being placed along slot 40 in accordance with the tangent of the angle (angle b, FIG. 5) of the main roof rise y (FIG. 5) over the known plan-projected length x (FIG. 5) of the hip rafter 216.

Referring now to FIGS. 2 through 5, a roof 200 comprises a main roof 202, including a ridge stud 204 supporting a ridge beam 206 and common rafters 208 extending between ridge beam 206 and sidewall plates 210; and a hip roof 212, including an endwall plate 214, hip rafters 216 extending from the intersections 218 of sidewall plates 210 and endwall plate 214 to the end 220 of ridge beam 206, first jack rafters 222 extending from the sidewall plates 210 to hip rafters 216, and second jack rafters 224 extending from endwall plate 214 to hip rafters 216. (Note that a valley rafter similarly extends from the wall plate to the ridge, but the jack rafters extend from the valley rafter to the ridge beam rather than to the wall plate.)

Although a hip rafter most commonly departs from the ridge and the last common rafter at a 45° plan angle c, the invention is easily applicable to any such angle of hip rafter 216 to the last common rafter 208 (there need not necessarily be a common rafter abutting the hip rafter; the angle formed by their extensions will be the same). A separate tool is required for each different plan angle c of the hip rafter to the last common rafter. Determining the dimensions and scaling of a tool is straightforward, however.

Example 1

Wherein Angle c=45°

First, determine length x, which is the plan or projected run of hip rafter 218. Since xg=secant 45°, if g=1, x=1.4142. Thus the length of 12-unit measuring scale 14 (FIG. 1) is 12 times 1.4142=16.9704 inches. Note that this is also the distance between parallel first and second scribing edges 16,18.

Second, determine angle b, wherein angle b=arctan y/x, for all of the main roof pitches of interest to construct arcuate increment scale 41 (FIG. 1).

Example 2

Wherein Angle c=22.5°

If g=1, x=1.0824. Thus the length of 12-unit measuring scale 14 (FIG. 1) is 12 times 1.0824=12.9888 inches.

Again, determine angle b for all of the main roof pitches of interest to construct arcuate increment scale 41.

In operation of an adjustable hip rafter framing tool 10 in accordance with the present invention, and still referring to FIGS. 1 through 5, the length of wall plate 210 from ridge beam end 220 to the hip rafter 216 is known in feet and inches, as is the run g of the common rafters. Thus, angle c is either designated a priori or readily calculated to select the framing tool 10 having the correct scales for angle c. Rafter pitch arm assembly 20 is set at the known rise 204 of main roof 202 as indicated on scale 41. Tool 10 is then laid against board 36 with second arm 24 against one edge 151 thereof. Measurement of the length of hip rafter 216 begins by scribing a reference line on board 150 along scribing edge 18, defining a reference end 38 of the hip rafter at the wall plate. The distance 152 between first and second scribing edges 16,18 along edge 151 thus represents the length in inches of hip rafter 216 corresponding to 12 inches of length of wall plate 210. Tool 10 is then advanced along the board by that same number of feet and inches, as expressed by measuring edge 14 and shown in FIG. 4, to arrive at the correct length z for hip rafter 216.

Tool 10 may be similarly employed to lay out the nailing locations for jack rafters 222 to be installed from wall plate 210 to hip rafter 216. For example, if the rafter spacing is 16 inches on-center on the wall plate, the tool is successively advanced on the hip rafter and marked every 16 "inches" on secant measuring scale 15.

Note that in the case of a 45° hip rafter angle c from common rafter 208, a 45° hip rafter angle d is also formed with the projected extension h of ridge beam 206. Thus, the 45° rafter framing tool may be used to mark off the nailing locations on both sides of the hip rafter. In all other cases wherein angles c and d differ, the same tool cannot be used on both sides of the hip rafter, as the jack rafter spacings along the hip rafter will differ on the hip and main roof sides.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An adjustable tool for laying out the length and jack rafter nailing pattern of a hip rafter in a hip roof portion of a main roof, comprising:

a) a planar body having a linear measuring edge and first and second linear scribing edges orthogonal to said linear measuring edge at respective opposite ends thereof, wherein said linear measuring edge is marked in a scale of equally spaced increments numerically equivalent to a length of a wall plate supportive of a lower end of said hip rafter, and wherein the spacing of said equally spaced increments equals said equivalent length of wall plate multiplied by the secant of the plan angle formed between said hip rafter and a common rafter; and b) a rafter pitch arm assembly including first and second arms disposed on opposite sides of said planar body and being rotatably mounted at a first location thereof on a pivot pin extending through said planar body, said first and second arms being connected at a second location thereof via a variable compression device extending through said first and second arms and through an arcuate slot formed in said planar body and centered on said pivot pin, wherein said arcuate slot is marked in increments denoting the pitch of the main roof.

2. A tool in accordance with claim 1 wherein said secant is the secant of 45 degrees.

3. A tool in accordance with claim 1 wherein said length of a wall plate supportive of a lower end of said hip rafter is 12 inches, and wherein said scale of equally spaced increments extends from 0 to 12, and wherein the width of said tool between said first and second scribing lines is 16.9705 inches.

4. A tool in accordance with claim 1 wherein said variable compression device includes a thumbscrew.

5. A tool in accordance with claim 1 wherein said planar body is formed of material selected from the group consisting of metal and plastic.

6. An adjustable tool for laying out the length of a valley rafter in a valley portion of a roof, comprising:

a) a planar body having a linear measuring edge and first and second linear scribing edges orthogonal to said linear measuring edge at respective opposite ends thereof, wherein said linear measuring edge is marked in a scale of equally spaced increments numerically equivalent to a length of a ridge beam supportive of an upper end of said valley rafter, and wherein the spacing of said equally spaced increments equals said equivalent length of ridge beam multiplied by the secant of the plan angle formed between said valley rafter and a common rafter; and b) a rafter pitch arm assembly including first and second arms disposed on opposite sides of said planar body and being rotatably mounted at a first location thereof on a pivot pin extending through said planar body, said first and second arms being connected at a second location thereof via a variable compression device extending through said first and second arms and through an arcuate slot formed in said planar body and centered on said pivot pin, wherein said arcuate slot is marked in increments denoting the pitch of the main roof.

7. A method for laying out the length of a hip rafter in a hip roof portion of a main roof, comprising the steps of:

a) providing an adjustable tool having i) a planar body having a linear measuring edge and first and second linear scribing edges orthogonal to said linear measuring edge at respective opposite ends thereof, wherein said linear measuring edge is marked in a scale of equally spaced increments numerically equivalent to a length of a wall plate supportive of a lower end of said hip rafter, and wherein the spacing of said equally spaced increments equals said equivalent length of wall plate multiplied by the secant of the plan angle formed between said hip rafter and a common rafter; and ii) a rafter pitch arm assembly including first and second arms disposed on opposite sides of said planar body and being rotatably mounted at a first location thereof on a pivot pin extending through said planar body, said first and second arms being connected at a second location thereof via a variable compression device extending through said first and second arms and through an arcuate slot formed in said planar body and centered on said pivot pin, wherein said arcuate slot is marked in increments denoting the pitch of the main roof;

b) setting said rafter pitch arm assembly at the pitch of the main roof as indicated at said arcuate slot;

c) placing said tool against a side of a board for forming said hip rafter, said second arm being against a corresponding edge of said board;

d) scribing a first line on said board along said second scribing edge to establish a reference end for said hip rafter;

e) determining the actual length of said wall plate to be subtended by said hip rafter; and f) sequentially advancing said tool along said board by a numerical distance as measured by said linear measuring edge equal to said actual length of said wall plate to determine the overall actual length of said hip rafter.

* * * * *